US008768242B2

(12) United States Patent
Frost et al.

(10) Patent No.: US 8,768,242 B2
(45) Date of Patent: Jul. 1, 2014

(54) REMOTE SATELLITE TERMINAL WITH ANTENNA POLARIZATION ALIGNMENT ENFORCEMENT AND ASSOCIATED METHODS

(75) Inventors: Alan Frost, Houston, TX (US); Steven Wheelis, Seabrook, TX (US); Jay Mueller, Houston, TX (US); Greg Myers, Pearland, TX (US)

(73) Assignee: Harris Corporation, Melbourne, FL (US)

( * ) Notice: Subject to any disclaimer, the term of this patent is extended or adjusted under 35 U.S.C. 154(b) by 347 days.

(21) Appl. No.: 13/435,266

(22) Filed: Mar. 30, 2012

(65) Prior Publication Data

US 2013/0260671 A1 Oct. 3, 2013

(51) Int. Cl.
*H04K 3/00* (2006.01)

(52) U.S. Cl.
USPC ..... 455/1; 455/63.4; 343/755; 343/756; 343/775

(58) Field of Classification Search
CPC ..... H04K 3/42; H04K 3/45; H04W 16/28
USPC ..... 455/1
See application file for complete search history.

(56) References Cited

U.S. PATENT DOCUMENTS

| | | | | |
|---|---|---|---|---|
| 5,890,787 | A * | 4/1999 | McNelley et al. | 353/28 |
| 6,128,276 | A * | 10/2000 | Agee | 370/208 |
| 6,166,610 | A * | 12/2000 | Ramanujam et al. | 333/21 A |
| 6,292,143 | B1 * | 9/2001 | Romanofsky | 343/700 MS |
| 6,297,897 | B1 * | 10/2001 | Czichy et al. | 398/122 |
| 6,570,528 | B1 * | 5/2003 | Rao et al. | 342/354 |
| 6,741,633 | B1 * | 5/2004 | Cangiani et al. | 375/132 |
| 6,771,225 | B2 * | 8/2004 | Tits | 343/786 |
| 6,778,887 | B2 * | 8/2004 | Britton | 701/21 |
| 7,248,841 | B2 * | 7/2007 | Agee et al. | 455/101 |
| 7,596,354 | B2 * | 9/2009 | Schiff | 455/63.4 |
| 7,652,625 | B2 * | 1/2010 | Small | 342/386 |
| 7,675,462 | B2 * | 3/2010 | Gerlinger et al. | 342/359 |
| 7,786,933 | B2 * | 8/2010 | Chang | 342/357.63 |
| 7,911,400 | B2 * | 3/2011 | Kaplan et al. | 343/713 |
| 8,035,562 | B2 * | 10/2011 | Chang | 342/417 |
| 8,170,158 | B2 * | 5/2012 | Thesling et al. | 375/346 |
| 8,200,150 | B2 * | 6/2012 | Lopez et al. | 455/13.2 |
| 8,232,918 | B2 * | 7/2012 | Chang | 342/368 |
| 8,331,505 | B2 * | 12/2012 | Abrishamkar et al. | 375/346 |
| 8,346,162 | B1 * | 1/2013 | Jayasimha et al. | 455/13.1 |
| 8,462,066 | B2 * | 6/2013 | Malasani | 343/766 |

(Continued)

OTHER PUBLICATIONS

"Hughes Outdoor Pointing Interface Operating Instructions" 1031832-0001; Revision C, Mar. 31, 2006.

*Primary Examiner* — Hai V Nguyen
(74) *Attorney, Agent, or Firm* — Allen, Dyer, Doppelt, Milbrath & Gilchrist, P.A.

(57) ABSTRACT

A communications system includes a satellite hub, a remote satellite terminal, and a satellite configured to provide communications therebetween. The remote terminal includes a controller that functions as an enforcement mechanism when adjusting antenna polarization on the remote satellite terminal to facilitate communications with the satellite. The satellite transmits an acquisition signal at a first satellite polarization angle, and a jamming signal at a second satellite polarization angle different from the first satellite polarization angle. If the polarization is not set correctly, then the jamming signal is not filtered by a narrow width null of the receive gain pattern at the remote satellite terminal, and the controller inhibits transmission. This forces an installer to correctly set the polarization of the antenna at the remote satellite terminal.

21 Claims, 4 Drawing Sheets

(56) References Cited

U.S. PATENT DOCUMENTS

| | | | | |
|---|---|---|---|---|
| 8,712,318 | * | 4/2014 | Norin | 455/3.02 |
| 2003/0030594 | A1* | 2/2003 | Larry | 343/895 |
| 2004/0030468 | A1* | 2/2004 | Britton | 701/21 |
| 2004/0051676 | A1 | 3/2004 | Travis et al. | |
| 2004/0095907 | A1* | 5/2004 | Agee et al. | 370/334 |
| 2006/0012521 | A1* | 1/2006 | Small | 342/386 |
| 2007/0135050 | A1* | 6/2007 | Schiff | 455/62 |
| 2008/0143600 | A1* | 6/2008 | Gerlinger et al. | 342/359 |
| 2008/0298516 | A1* | 12/2008 | Norin | 375/344 |
| 2009/0086862 | A1* | 4/2009 | Thesling et al. | 375/346 |
| 2010/0045510 | A1 | 2/2010 | Lopez et al. | |
| 2011/0057849 | A1 | 3/2011 | Naym et al. | |

* cited by examiner

REMOTE SATELLITE TERMINAL WITH ANTENNA POLARIZATION ALIGNMENT ENFORCEMENT AND ASSOCIATED METHODS

FIELD OF THE INVENTION

The present invention relates to the field of wireless communications, and more particularly, to a system and method for antenna polarization alignment for a remote satellite terminal to facilitate communications with a satellite.

BACKGROUND OF THE INVENTION

For satellite operators who support remote satellite terminals with a very small aperture terminal (VSAT) system, setting the antenna polarization on the remote satellite terminal is necessary for interference free operation of the satellite communications payload that is operating on an opposite orthogonal polarization of the satellite. With a 2-port antenna feed in a typical low cost antenna, it is difficult for an installer commissioning the remote satellite terminal to determine empirically if the antenna polarization on the remote satellite terminal is correct. This is due to the broad nature of the co-polarization peak and the narrow nature of the cross polarization null with regards to the angular displacement of a linearly polarized feed on a typical satellite antenna system.

The relationship of how transmit polarization 12 and receive polarization 10 are adjusted around the boresite of the antenna 32 is provided in FIG. 1. As indicated by arrow 13, rotation of the satellite antenna feed system 33 effects the transmit/receive polarizations 12, 10 of the antenna 32 around the boresite.

The correct polarization angle is defined as the angle at which the remote satellite terminal polarization characteristics of the signal transmitted by the antenna are aligned with the polarization characteristics of the antenna system on the satellite being accessed. Ideally, the co-polarized receive gain and cross polarized transmit gain of the VSAT system exactly matches the rotational angle of the satellite antenna feed system.

An incorrect polarization setting between a remote satellite terminal and a satellite is shown in FIG. 2. The co-polarization receive gain is indicated by reference 10 and the cross polarization transmit gain is indicated by reference 12. The satellite polarization setting 11 is offset from the feed polarization angle 6 at the satellite, as indicated by reference 14. Similarly, the co-polarization receive gain 10 is offset from the feed polarization angle displacement θ at the satellite, as indicated by reference 15.

Since the co-polarization receive gain 10 exhibits a very broad peak for receiving an acquisition signal from the satellite, the offset 15 minimally impacts reception of the acquisition signal. However, this offset 14 for the cross polarization transmit gain 12 causes a significant amount of energy to be transmitted into the opposite polarization, which causes cross polarization interference at the satellite.

To alleviate this issue with large populations of mobile VSAT systems, the normal practice is for the installer to call to a Network Operations Center (NOC), and under instruction from an operator, set the polarization with the operator. The operator has access to an earth station antenna fitted with the equipment to see signals on both polarizations.

The operator feeds back the empirical observation of the relative levels of the desired (co-polarized) signal and the undesired (cross polarized) signal. Frequencies are set aside on satellites for this application. Since the signals used for the measurement are typically single frequency sinusoidal (known as continuous wave or CW) and are generated by the transmission apparatus of the terminal, the VSAT terminal can not carry any traffic in this state. Therefore, communications between the installer and the operator requires a communications channel separate from the normal VSAT bearer channel.

As the number of VSAT systems have increased, and, in particular, VSAT systems that are in a semi-mobile (also known as nomadic) operation, the burden on network operators and installers with this polarization setting technique has increased dramatically. Since one space segment resource and one network operator is occupied full time for approximately 30 minutes, the technique is very difficult and expensive to scale.

In addition, since there is no mechanism to enforce the installer setting the cross polarization on the VSAT system, there has also been an increase in the number and severity of incidents of interference on the opposite polarization. Installers will simply point the antenna at the satellite and once the electronics package joins the network, they think that they are done. Very often, the remote satellite terminal with an incorrect polarization setting will operate satisfactorily on co-polarized receive due to the broad nature of the co-polarization peak, but the cross polarized transmit gain is not aligned correctly, as illustrated in FIG. 2. This offset results in the cross polarized transmit gain causing cross polarization interference on the opposite polarization at the satellite. The cross polarization interference needs to be resolved, which is an even more difficult and expensive analysis and remediation process.

One approach for aligning antenna polarization for a VSAT system is provided by Hughes Network Solutions, LLC. Hughes provides outdoor pointing interface (OPI) operating instructions that provide feedback from the pointing software to the installer at the VSAT system during the pointing process. However, Hughes OPI still allows the remote satellite terminal to operate satisfactory with the co-polarized receive gain even if the cross polarized transmit gain is not aligned correctly, which causes cross polarization interference at the satellite.

Other automated or non-interventional techniques have been developed that replicate the function of the Network Operator robotically. These techniques, while reducing the burden on the Network Operations centers, and at times successfully enforcing cross polarization discipline amongst the installers, are typically very complex and expensive to implement, and suffer from many of the same scalability problems as the normal procedure of human intervention.

SUMMARY OF THE INVENTION

In view of the foregoing background, it is therefore an object of the present invention to provide an enforcement mechanism when adjusting antenna polarization on a remote satellite terminal to facilitate communications with a satellite.

This and other objects, features, and advantages in accordance with the present invention are provided by a communications system comprising a satellite hub, a remote satellite terminal, and a satellite configured to provide communications therebetween. The satellite is configured to transmit to the remote satellite terminal an acquisition signal at a first satellite polarization angle, and a jamming signal at a second satellite polarization angle different from the first satellite polarization angle.

The remote satellite terminal comprises an antenna defining first and second remote terminal polarization angles being adjustable to obtain polarization alignment with the respective first and second satellite polarization angles. A receive gain pattern is relatively wide about the first remote terminal polarization angle, and has a narrow width null at the second remote terminal polarization angle. A transmit gain pattern has a narrow width peak at the second remote terminal polarization angle. The remote terminal further comprises a remote terminal controller configured to inhibit transmission without polarization alignment as determined based upon receiving the acquisition signal, while filtering the jamming signal with the narrow width null of the receive gain pattern.

In other words, the antenna defines a mechanically coupled orthogonal remote terminal with transmit and receive polarization angles being adjustable to obtain polarization alignment with the respective receive and transmit satellite polarization angles. The co-polarization receive gain pattern is relatively wide with regard to angular displacement about the remote terminal polarization angle, and has a narrow width null at the orthogonal remote terminal polarization angle. The transmit gain pattern has a broad peak at the orthogonal remote terminal polarization angle to the receive's broad peak and a narrow null at the parallel to the receive peak. Likewise, the receive characteristic has a narrow null at the same polarization angle as the transmit's peak. The remote terminal controller is thus configured to inhibit transmission without polarization alignment as determined based upon receiving the acquisition signal with the broad co-polarization characteristic of the antenna, while filtering the jamming signal with the narrow width cross polarization null of the receive gain pattern.

The remote terminal controller advantageously functions as an enforcement mechanism based on generation of the jamming signal by the satellite. The jamming signal may be on the opposite polarization, but at the same frequency as the acquisition signal, and is used to determine whether or not the remote terminal controller inhibits transmission at the remote satellite terminal. If the polarization is not set correctly, then the jamming signal is not filtered by the narrow width null of the receive gain pattern, and the remote terminal controller inhibits transmission. This advantageously forces an installer to correctly set the polarization of the antenna at the remote satellite terminal.

The first and second satellite polarization angles may be orthogonal, and the first and second remote terminal polarization angles may also be orthogonal. The remote satellite terminal may comprise a Very Small Aperture Terminal (VSAT) system, for example.

The antenna for the remote satellite terminal may comprise a reflector and antenna feed assembly coupled thereto. The remote satellite terminal may further comprise a base adjustably supporting the reflector to permit polarization alignment.

The antenna feed assembly may comprise a receive antenna feed at the first remote terminal polarization angle, and a transmit antenna feed at the second remote terminal polarization angle. The remote satellite terminal may further comprise a receiver coupled to the receive antenna feed, and a transmitter coupled to the transmit antenna feed. The receiver and transmitter may be coupled to the remote terminal controller.

Another aspect of the present invention is directed to a method for operating the communications system as described above. The method comprises operating the satellite to transmit to the remote satellite terminal an acquisition signal at a first satellite polarization angle, and a jamming signal at a second satellite polarization angle different from the first satellite polarization angle. The remote terminal controller is operated to inhibit transmission without polarization alignment as determined based upon receiving the acquisition signal while filtering the jamming signal with the narrow width null of the receive gain pattern. The first and second remote terminal polarization angles at the antenna on the remote satellite terminal are adjusted to obtain polarization alignment with the respective first and second satellite polarization angles.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
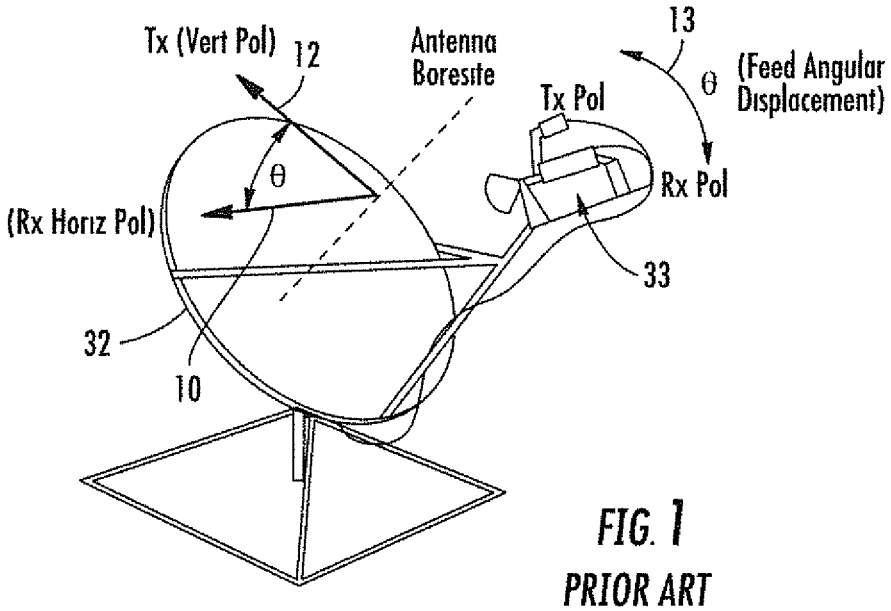
FIG. 1 PRIOR ART
FIG. 1 is a schematic diagram showing the relationship between antenna boresite adjustment and feed angular displacement in accordance with the prior art.
Figure 2:
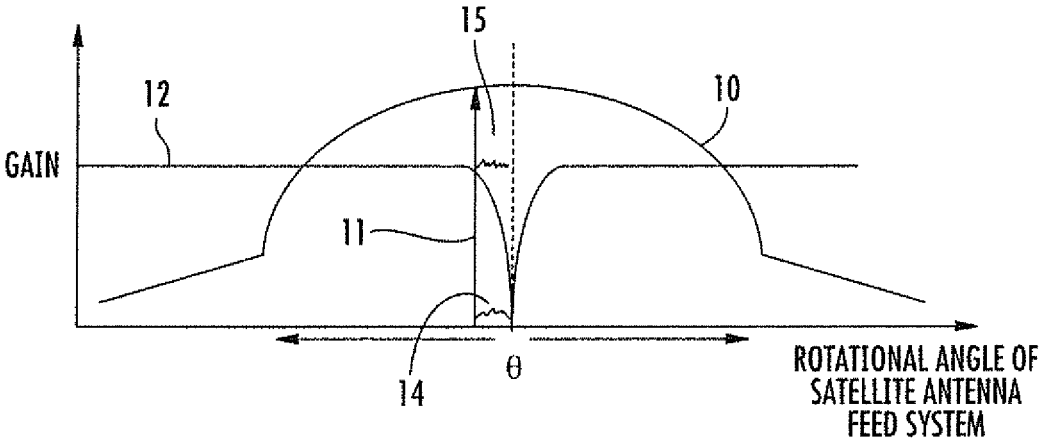
FIG. 2 PRIOR ART
FIG. 2 is a plot illustrating an incorrect polarization setting between a remote satellite terminal and a satellite in accordance with the prior art.
Figure 3:
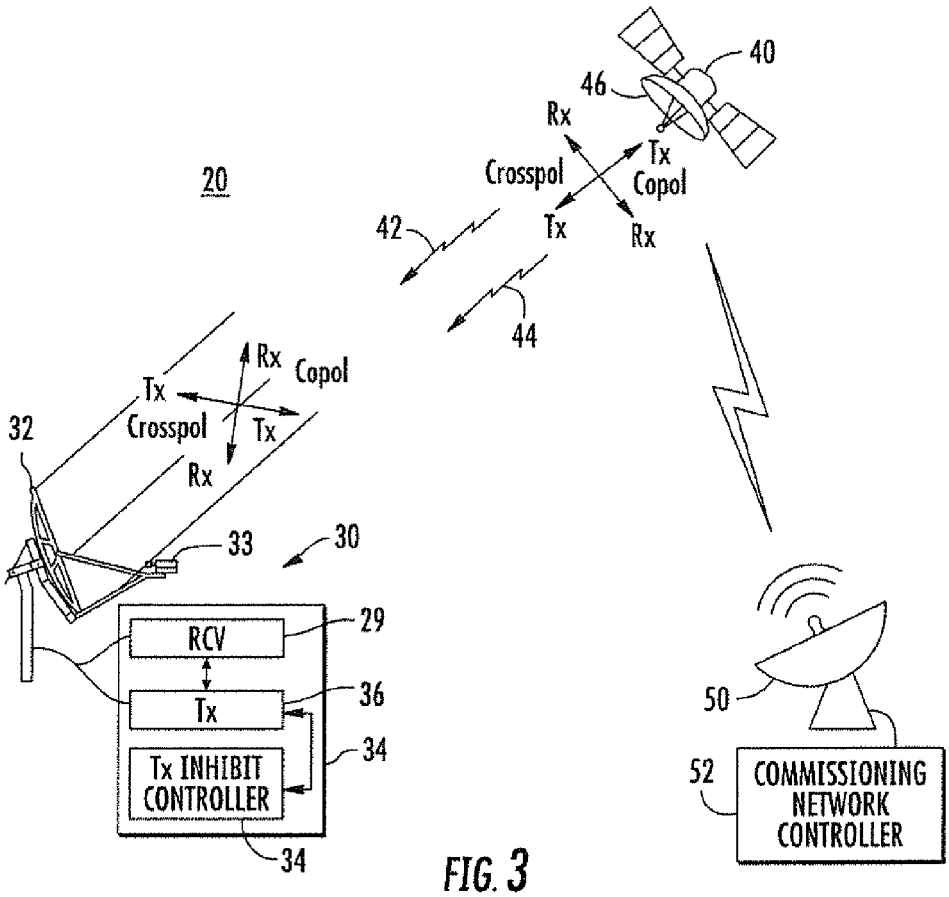
FIG. 3 is a schematic diagram of a communications system including a satellite hub, a remote satellite terminal and a satellite in accordance with the present invention.
Figure 4:
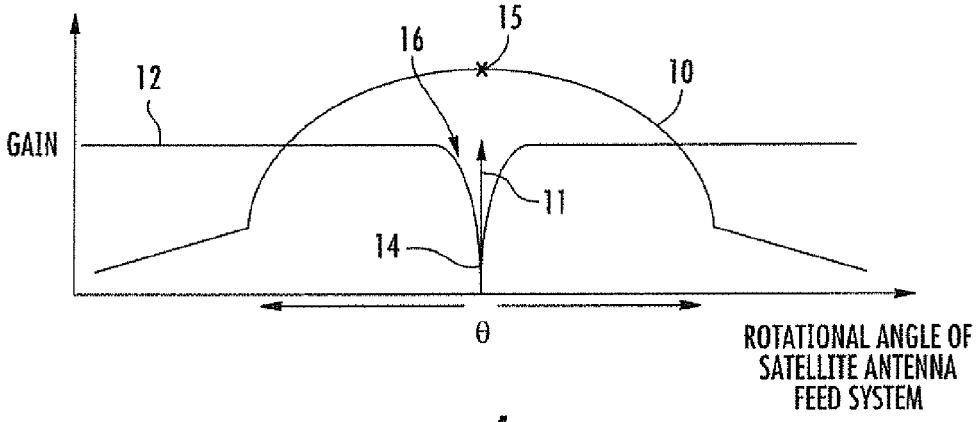
FIG. 4 is a plot illustrating a correct polarization setting between a remote satellite terminal and a satellite in accordance with the present invention.

Referring initially to FIGS. 3 and 4, a communications system 20 with an enforcement mechanism to assist when adjusting antenna polarization on a remote satellite terminal 30 to facilitate communications with a satellite 40 will now be discussed. The communications system 20 includes a satellite hub 50, the remote satellite terminal 30, and the satellite 40 configured to provide communications therebetween. The satellite hub 50 includes a commissioning network controller 52 configured to operate the satellite 40.

The satellite 40 is configured to transmit to the remote satellite terminal 30 an acquisition signal 42 at a first satellite polarization angle, and a jamming signal 44 at a second satellite polarization angle different from the first satellite polarization angle. The first and second satellite polarization angles may be orthogonal, for example. The acquisition signal 42 and the jamming signal 44 are continuously transmitted from the satellite 40.

The remote satellite terminal 30 includes an antenna 32 coupled thereto defining first and second remote terminal polarization angles being adjustable to obtain polarization alignment with the respective first and second satellite polarization angles. The first and second remote terminal polarization angles may be orthogonal, for example.

As illustrated in FIG. 4, the remote satellite terminal 30 includes a receive gain pattern 10 that is relatively wide about the first remote terminal polarization angle, and has a narrow width null 16 at the second remote terminal polarization angle. A transmit gain pattern 12 has a narrow width null at the second remote terminal polarization angle. The remote satellite terminal 30 further includes a remote terminal controller 34 configured to inhibit transmission without polarization alignment as determined based upon receiving the acquisition signal 42 while filtering the jamming signal 44 with the narrow width null of the receive gain pattern 16.

As will now explained in greater detail below, the enforcement mechanism takes advantage of the reciprocity theory of electromagnetic radiation structures. This theory is based on a radiating structure demonstrating the same pattern characteristics on transmit and receive, when all other factors are held constant.

A small operational communications network (e.g., a commissioning network or C-net) is provided at frequencies on the satellite 40 that can accept cross polarization interference. The acquisition signal 42 from the satellite is at the same frequency as the jamming signal 44 but on the opposite polarization.

For illustration purposes, the receive gain pattern 10 that is relatively wide about the first remote terminal polarization angle corresponds to a co-polarization, and the narrow width null 16 at the second remote terminal polarization angle corresponds to a cross polarization. The transmit gain pattern 12 having the narrow width peak at the second remote terminal polarization angle corresponds to a cross polarization.

Since the receive cross polarization null 16 and the transmit cross polarization null 12 are typically within 0.01 to 0.05 degrees of angular displacement of each other, setting the receive polarization properly will also correctly set the transmit polarization. The receive cross polarization characteristics (deep narrow null) 16 will cause the jamming signal 44 on the opposite polarization to jam the desired polarization receive of the acquisition signal 42 unless the polarization of the antenna 32 on the remote satellite terminal 30 is set properly.

In other words, if the polarization of the antenna 32 on the remote satellite terminal 30 is set correctly, as shown in FIG. 4, the jamming signal 44 from the satellite is received within the receive cross polarization null 16 at the remote satellite terminal 30. This then allows the acquisition signal 42 from the satellite 30 to be received by the receive gain pattern 10 on the remote satellite terminal 30. The co-polarization receive gain 10 is also aligned with the feed polarization angle displacement θ at the satellite, as indicated by reference 15.

Since the polarization at the antenna 32 on the remote satellite terminal 30 is set correctly, energy from the opposite polarization (i.e., the jamming signal 44) will be attenuated by the receive cross polarization 16 discrimination that is on the opposite polarization. For commercial VSAT systems, this discrimination is approximately 30 dB.

With the acquisition signal 42 now being received by the remote satellite terminal 30 while the jamming signal 44 is also being filtered/attenuated by the remote satellite terminal, a receiver 29 and a transmitter 36 within the remote satellite terminal 30 is able to join the network. This means that the cross polarization transmit gain 12 will not cause cross polarization interference at the satellite 40.

The receiver 29 and transmitter 36 are typically packaged within a modem. Once the modem is able to transmit and receive, it pings back to the hub 50 to show that it has connectivity. The modem then reboots so that it is able to get on the production network to receive useful traffic. Connecting to the production network typically requires a test and authentication process to confirm performance of the antenna 32, and to permit the antenna to join the production network, as readily appreciated by those skilled in the art. The production network is the traffic-bearing network.

Without the jamming signal 44, there would be no significant in-band energy on an opposite polarization from the acquisition signal 42, thus allowing the polarization at the remote satellite terminal 30 to be set inaccurately. As noted above, a remote satellite terminal 30 with an incorrect polarization setting will still receive the acquisition signal 42 at a level that enables communications. At this point, the installer may assume polarization is correct since the acquisition signal 42 is being satisfactorily received. However, the transmit signal 12 from the remote satellite terminal 30 will have significant gain on the opposite polarization and interference will occur at the satellite 40. The enforcement mechanism of the remote terminal controller 34 advantageously prevents this from occurring.

The jamming signal 44 introduced on the opposite polarization, but at the same frequency as the acquisition signal 42, is advantageously used to determine whether or not the remote terminal controller 34 inhibits transmission of the transmitter 36 at the remote satellite terminal 30. If the polarization is not set correctly, then the jamming signal 44 is not filter/attenuated by the receive cross polarization null 16, and the remote terminal controller 34 inhibits transmission of the transmitter 36.

Inhibiting transmission is due to the FCC mandated interlock between transmit and receive on all VSAT electronics packages. The remote satellite terminal 30 will not be allowed to transmit any type of carrier to the satellite 40 if the modem does not first acquire the acquisition signal 42 from the satellite 40.

If the modem is not able to connect to the production network within a certain period of time, the modem has access to what is referred to as a jail network. A jail network is a small network like the C-net but without the jamming carrier. It allows the installer to get into the network by providing a communications path to an operator that can assist with trouble shooting the problem.

Before the jail network option, the installer attempts to correctly set the polarization of the antenna 32 at the remote satellite terminal 30. This is done by the installer slowly adjusting the antenna pointing and polarization until the receiver/transceiver 36 joins the C-net, at which point the installer will be able to do the authentication process. This means that the jamming signal 44 is being filtered/attenuated by the receive cross polarization 16 discrimination that is on the opposite polarization. As noted above, this discrimination is approximately 30 dB for commercial VSAT antennas.

Figure 5:
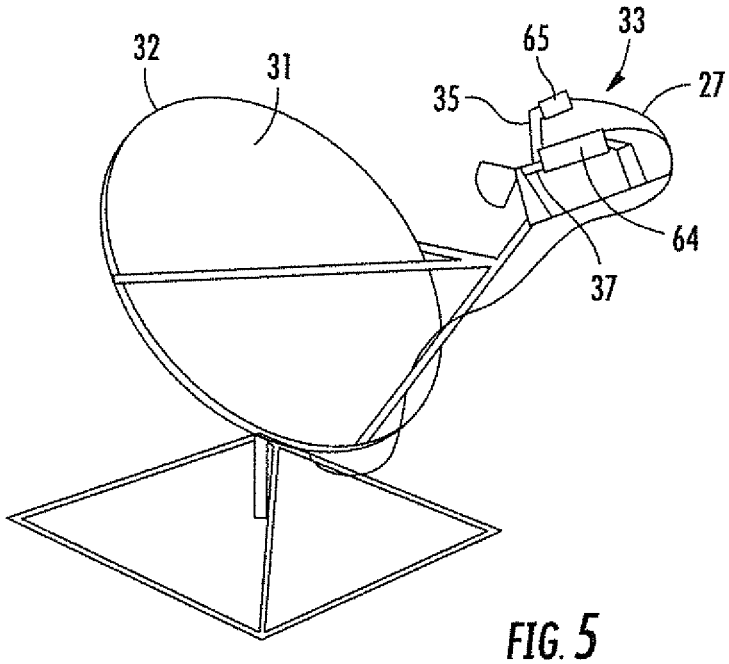
FIG. 5 is a schematic diagram of an antenna with a reflector and antenna feed assembly coupled thereto for the remote satellite terminal illustrated in FIG. 3.

More particularly, the remote satellite terminal 30 may be configured as a Very Small Aperture Terminal (VSAT) system as discussed above. The antenna 32 for the VSAT includes a reflector 31 and an antenna feed assembly 33 coupled thereto. The antenna feed assembly 33 includes a receive antenna feed 35 at the first remote terminal polarization angle, and a transmit antenna feed 37 at the second remote terminal polarization angle, as illustrated in FIG. 5.

A low noise amplifier 65 is coupled to the receive antenna feed 35, and an amplifier 67 is coupled to the transmit antenna feed 37. The receiver 29 is coupled to the low noise amplifier 65 via cabling 27. The amplifier 67 is coupled to the amplifier 64 via cabling 27 as well as being coupled to the remote terminal controller 34, which inhibits transmission when the polarization is not set correctly.

Figure 6:
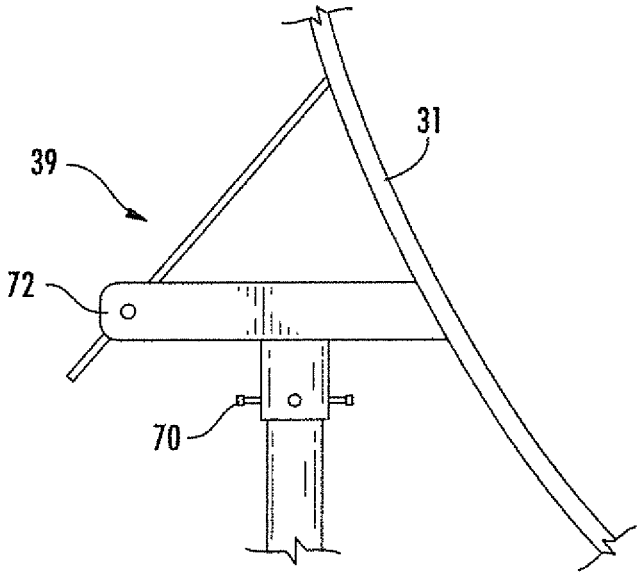
FIG. 6 is a schematic diagram of a side view of the antenna illustrated in FIG. 5 with a base adjustably supporting the reflector to permit polarization alignment.

As discussed above, the receiver 29 and transmitter 36 are typically packaged within a modem. Although the remote terminal controller 34 is illustrated as being separate and spaced apart from the receiver 29 and transmitter 36, it may be co-located with the receiver 29 and transmitter 36, as readily appreciated by those skilled in the art. The remote satellite terminal 30 also includes a base 39 that is adjustably supporting the reflector 31 to permit polarization alignment, as illustrated in FIG. 6. Bolts 70 are loosened so as to horizontally rotate the antenna 30, whereas bolt 72 is loosened so as to vertically rotate the antenna 30.

Figure 7:
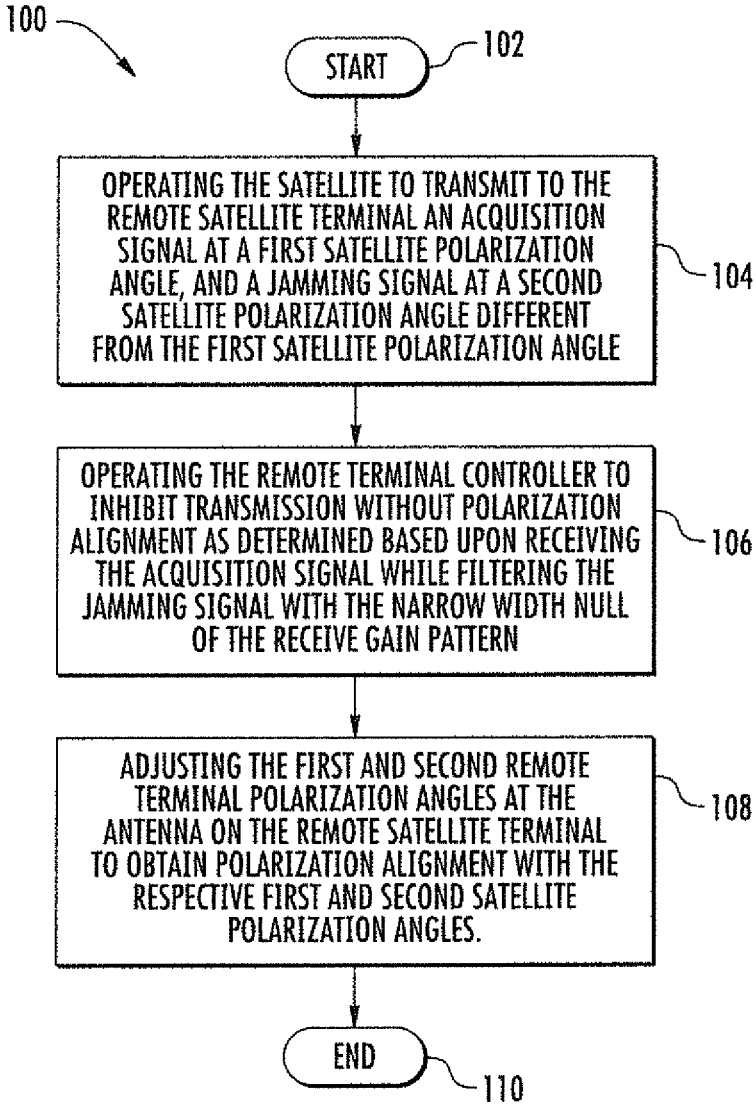
FIG. 7 is a flowchart illustrating a method for operating a communications system in accordance with the present invention.

A flowchart 100 illustrating a method for operating the communications system 20 as described above will now be discussed in reference to FIG. 7. From the start (Block 102), the method comprises operating the satellite 40 to transmit to the remote satellite terminal 30 at Block 104 an acquisition signal 42 at a first satellite polarization angle, and a jamming signal 44 at a second satellite polarization angle different from the first satellite polarization angle. The remote terminal controller 34 is operated at Block 106 to inhibit transmission without polarization alignment as determined based upon receiving the acquisition signal 42 while filtering the jamming signal 44 with the narrow width null 16 of the receive gain pattern. The first and second remote terminal polarization angles at the antenna 32 on the remote satellite terminal 30 are adjusted at Block 108 to obtain polarization alignment with the respective first and second satellite polarization angles. The method ends at Block 110.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A communications system comprising:

a satellite hub, a remote satellite terminal, and a satellite configured to provide communications therebetween;

said satellite configured to transmit to said remote satellite terminal an acquisition signal at a first satellite polarization angle, and a jamming signal at a second satellite polarization angle different from the first satellite polarization angle;

said remote satellite terminal comprising an antenna defining first and second remote terminal polarization angles being adjustable to obtain polarization alignment with the respective first and second satellite polarization angles, a receive gain pattern being relatively wide about the first remote terminal polarization angle, and having a narrow width null at the second remote terminal polarization angle, and a transmit gain pattern having a narrow width peak at the second remote terminal polarization angle;

said remote terminal further comprising a remote terminal controller configured to inhibit transmission without polarization alignment as determined based upon receiving the acquisition signal while filtering the jamming signal with the narrow width null of the receive gain pattern.

2. The communications system according to claim 1 wherein the first and second satellite polarization angles are orthogonal; and wherein the first and second remote terminal polarization angles are orthogonal.

3. The communications system according to claim 1 wherein said remote satellite terminal comprises a Very Small Aperture Terminal (VSAT) system.

4. The communications system according to claim 1 wherein said antenna for said remote satellite terminal comprises a reflector and antenna feed assembly coupled thereto.

5. The communications system according to claim 4 wherein said remote satellite terminal further comprises a base adjustably supporting said reflector to permit polarization alignment.

6. The communications system according to claim 4 wherein said antenna feed assembly comprises a receive antenna feed at the first remote terminal polarization angle, and a transmit antenna feed at the second remote terminal polarization angle.

7. The communications system according to claim 6 wherein said remote satellite terminal further comprises a receiver coupled to said receive antenna feed, and a transmitter coupled to said transmit antenna feed; and wherein said receiver and transmitter are coupled to said remote terminal controller.

8. The communications system according to claim 1 further comprising a commissioning network controller configured to operate said satellite.

9. A method for operating a satellite hub, a remote satellite terminal, and a satellite configured to provide communications therebetween, the remote satellite terminal comprising an antenna defining first and second remote terminal polarization angles being adjustable to obtain polarization alignment with respective first and second satellite polarization angles, a receive gain pattern being relatively wide about the first remote terminal polarization angle, and having a narrow width null at the second remote terminal polarization angle, and a transmit gain pattern having a narrow width peak at the second remote terminal polarization angle, the method comprising:

using the satellite to transmit to the remote satellite terminal an acquisition signal at the first satellite polarization angle, and a jamming signal at the second satellite polarization angle; and using a remote terminal controller to inhibit transmission of the remote satellite terminal without polarization alignment as determined based upon receiving the acquisition signal while filtering the jamming signal with the narrow width null of the receive gain pattern.

10. The method according to claim 9 wherein the first and second satellite polarization angles are orthogonal; and wherein the first and second remote terminal polarization angles are orthogonal.

11. The method according to claim 9 wherein the remote satellite terminal comprises a Very Small Aperture Terminal (VSAT) system.

12. The method according to claim 9 wherein the antenna for the remote satellite terminal comprises a reflector and antenna feed assembly coupled thereto.

13. The method according to claim 12 wherein the remote satellite terminal further comprises a base adjustably supporting the reflector to permit polarization alignment.

14. A method for operating a communications system comprising a satellite hub, a remote satellite terminal, and a satellite configured to provide communications therebetween, with the remote satellite terminal comprising an antenna and a remote terminal controller, with the antenna including a receive gain pattern being relatively wide about a first remote terminal polarization angle, and having a narrow width null at a second remote terminal polarization angle, and a transmit gain pattern having a narrow width peak at the second remote terminal polarization angle, the method comprising:

operating the satellite to transmit to the remote satellite terminal an acquisition signal at a first satellite polarization angle, and a jamming signal at a second satellite polarization angle different from the first satellite polarization angle;

operating the remote terminal controller to inhibit transmission without polarization alignment as determined based upon receiving the acquisition signal while filtering the jamming signal with the narrow width null of the receive gain pattern; and adjusting the first and second remote terminal polarization angles of the antenna on the remote satellite terminal to obtain polarization alignment with the respective first and second satellite polarization angles.

15. The method according to claim 14 wherein the first and second satellite polarization angles are orthogonal; and wherein the first and second remote terminal polarization angles are orthogonal.

16. The method according to claim 14 wherein the remote satellite terminal comprises a Very Small Aperture Terminal (VSAT) system.

17. The method according to claim 14 wherein the antenna for the remote satellite terminal comprises a reflector and antenna feed assembly coupled thereto.

18. The method according to claim 17 wherein the remote satellite terminal further comprises a base adjustably supporting the reflector to permit polarization alignment.

19. The method according to claim 17 wherein the antenna feed assembly comprises a receive antenna feed at the first remote terminal polarization angle, and a transmit antenna feed at the second remote terminal polarization angle.

20. The method according to claim 14 wherein the remote satellite terminal further comprises a receiver coupled to the receive antenna feed, and a transmitter coupled to the transmit antenna feed; and wherein the receiver and transmitter are coupled to the remote terminal controller.

21. The method according to claim 14 wherein the communications system further comprises a commissioning network controller configured to operate the satellite.

* * * * *